US008770397B2

(12) United States Patent
Holley, Jr.

(10) Patent No.: US 8,770,397 B2
(45) Date of Patent: Jul. 8, 2014

(54) CUTTING METHOD TO PREVENT INTERLOCKING OF ADJACENT PANELS

(75) Inventor: John M. Holley, Jr., Lawrenceville, GA (US)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 687 days.

(21) Appl. No.: 12/093,882

(22) PCT Filed: Nov. 17, 2005

(86) PCT No.: PCT/US2005/041650

§ 371 (c)(1),
(2), (4) Date: May 15, 2008

(87) PCT Pub. No.: WO2007/058656

PCT Pub. Date: May 24, 2007

(65) Prior Publication Data

US 2008/0314213 A1 Dec. 25, 2008

(51) Int. Cl.

| | |
|---|---|
| ***B65D 75/00*** | (2006.01) |
| ***B31B 1/22*** | (2006.01) |
| ***B65D 71/58*** | (2006.01) |
| ***B26D 7/18*** | (2006.01) |
| *B26F 1/38* | (2006.01) |

(52) U.S. Cl.

CPC ..... *B65D 71/0022* (2013.01); *B31B 1/22* (2013.01); *B65D 2571/00802* (2013.01); *B31B 2201/147* (2013.01); *B65D 2571/00388* (2013.01); *B65D 2571/00487* (2013.01); *B65D 2571/00141* (2013.01); *B65D 2571/00956* (2013.01); *B65D 2571/00524* (2013.01); *B65D 2571/0066* (2013.01); *B26F 1/38* (2013.01); *B26D 7/18* (2013.01); *B31B 2201/148* (2013.01)

USPC ..... 206/188

(58) Field of Classification Search

USPC ..... 206/162, 139, 143, 144, 155, 163, 165, 206/169, 175, 188, 187, 822, 429, 427, 161, 206/173, 180, 179, 191, 193, 192

See application file for complete search history.

(56) References Cited

U.S. PATENT DOCUMENTS

| | | | | |
|---|---|---|---|---|
| 2,772,020 | A | 11/1956 | Kramer | |
| 2,977,021 | A | 3/1961 | Shiels, Jr. | |
| 3,029,977 | A | 4/1962 | Arneson | |
| 3,198,380 | A | 8/1965 | Gish et al. | |
| 3,208,632 | A | 9/1965 | Graser | |
| 3,297,197 | A * | 1/1967 | Woodling | 206/188 |
| 3,326,411 | A | 6/1967 | Crouch | |
| 3,432,073 | A | 3/1969 | Forrer | |
| 3,447,717 | A | 6/1969 | Forrer | |
| 3,487,975 | A * | 1/1970 | Riddell | 206/186 |

(Continued)

*Primary Examiner* — Jacob K Ackun
*Assistant Examiner* — Jenine Pagan
(74) *Attorney, Agent, or Firm* — MeadWestvaco Intellectual Property Group

(57) ABSTRACT

A method for removing material between the panels of a foldable blank (100), includes the steps of: separating at least a portion of the blank with a contoured line (25) to define a first panel (15) and a second panel (20), terminating the contoured line at a vertex (V), selecting one of the first and second panels as a trimmed panel (15) from which material is to be removed, defining a first line (R) that includes a pair of first and second points (P1, P2) on an edge of the trimmed panel, and removing a portion (A) of the trimmed panel defined by the first line and a section of the edge lying between the first and second points.

12 Claims, 6 Drawing Sheets

(56) References Cited

U.S. PATENT DOCUMENTS

| | | | | |
|---|---|---|---|---|
| 3,572,542 | A | 3/1971 | Wood et al. | |
| 3,572,544 | A * | 3/1971 | Forrer | 206/187 |
| 3,794,210 | A * | 2/1974 | Stout | 206/173 |
| 5,029,698 | A * | 7/1991 | Stout | 206/188 |
| 5,040,672 | A * | 8/1991 | DeMaio et al. | 206/162 |
| 5,400,901 | A * | 3/1995 | Harrelson | 206/143 |
| 5,590,762 | A * | 1/1997 | Harrelson | 206/162 |
| D394,205 | S | 5/1998 | Bates | |
| 6,003,665 | A * | 12/1999 | Stout | 206/160 |
| 6,102,197 | A * | 8/2000 | Negelen | 206/193 |
| 6,189,687 | B1 | 2/2001 | Bakx | |
| 6,341,692 | B1 * | 1/2002 | Miller | 206/431 |
| 6,571,941 | B2 | 6/2003 | Holley, Jr. | |
| 2003/0141353 | A1 | 7/2003 | Wilson | |

* cited by examiner

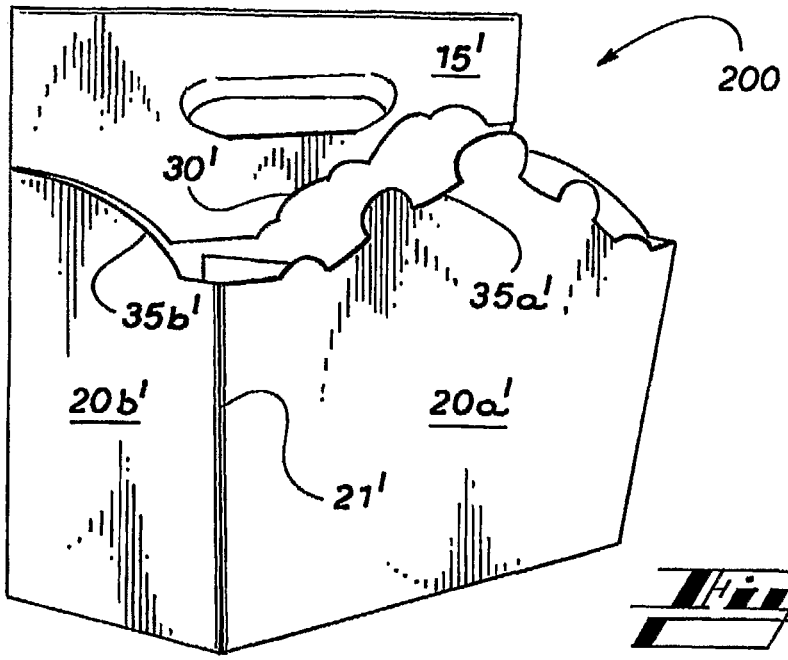
Fig_10
Fig_11
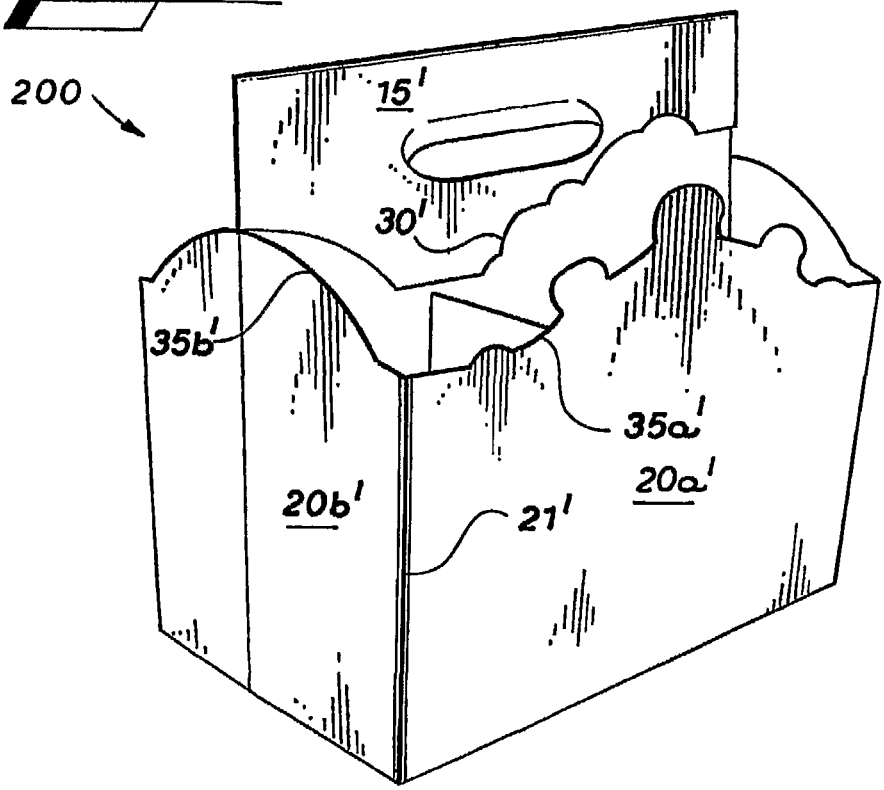

CUTTING METHOD TO PREVENT INTERLOCKING OF ADJACENT PANELS

TECHNICAL FIELD

This invention relates generally to article carriers and, more specifically, to a method for removing material from an article carrier blank to prevent interlocking of adjacent panels.

BACKGROUND OF THE INVENTION

Certain article carrier blanks may have a handle panel that is separated from a respective side panel, and sometimes one or more respective end panels, by a contoured cut line. When the article carrier blank is folded or otherwise assembled, the handle panel and the side panel tend to pivotally rotate or otherwise displace from an aligned position. If the pivotal rotation or displacement causes the handle panel edge to at least partially overlap the side panel edge, the side panel may become trapped as the handle panel is assembled to form the handle of the article carrier. If the side panel is trapped under the handle panel, one or both panels may be damaged as the side panel is pulled from the handle panel to erect the article carrier.

In most instances, the handle panel and the side panel of an article carrier blank do not risk overlap if the cut line between the panels is substantially straight. Accordingly, article carrier blanks have generally exhibited straight or nearly straight cut lines between the handle panel and the side panel to eliminate or limit overlap between the panels, which causes the erected article carriers to have a side wall with a top edge that is substantially straight. However, a contoured top edge of an article carrier is desired so that the top edge of the article carrier may provide a more aesthetic appearance, or incorporate trade dress, or provide varying heights of support for the articles.

Factors that affect how two panels overlap include the amount of pivotal rotation that is allowed, the amount of displacement created by the amount of pivotal rotation, and the contour of the cut line between the two panels. A certain group of article carrier blanks allows a significant amount of pivotal rotation between two panels. In this group, the handle panel is connected to the blank along only one section of its edge and the edge is formed, at least partially, by a cut line that separates the handle panel from the side panel. Since the handle panel is only supported along one section of its edge, the folded handle panel has substantial freedom to pivot about the vertex, which is the point where the cut line ends and the edges of the handle panel and the side panel meet. Some examples of this group of article carrier blanks are U.S. Pat. Nos. 3,432,073 (handle panels 30, 31); 3,447,717 (handle panels 12, 13, 17, 18); 2,772,020 (handle panels 44, 45); 2,977,021 (handle panel 46); 3,198,380 (handle panels 24, 25); and 3,208,632 (handle panels 13, 14).

The amount of displacement of a panel that is pivotally rotated increases as the radial distance from the vertex increases along the edge of the panel. More displacement between panels may cause more overlap. Additionally, the number of overlapping sections of a handle panel and a side panel tends to increase as the edge of a handle panel and of a side panel extend further along a long, continuous contoured cut line. The group of article carrier blanks listed above is also representative of article carrier blanks with long, continuous cut lines. Article carrier blanks with shorter cut lines between the handle panel and the side panel (U.S. Pat. Nos. 3,029,977; 3,572,542; 3,326,411; 6,571,941) may incur overlapping if the cut lines are contoured such that a small angular displacement causes overlap.

In article carrier blanks where the edge of the handle panel and the edge of the side panel meet at both ends of the cut line (U.S. Pat. No. 6,189,687), the panels may rotate about either vertex but will not rotate or displace as much since each end is supported. Therefore, panels that are separated by a cut line, which meet at both ends of the cut line, may not overlap unless the cut line is long and continuous and/or the cut line is highly contoured.

A heretofore unaddressed need exists in the industry to address the aforementioned deficiencies and inadequacies. What is needed is a method to produce an article carrier blank that has a contoured cut line, which separates a handle panel and a side panel, and can be folded or otherwise assembled such that the panels do not overlap as the article carrier blank is erected to form the article carrier.

SUMMARY OF THE INVENTION

The various embodiments of the present invention overcome the shortcomings of the prior art by providing a method to remove material from an article carrier blank. The method is useful for article carrier blanks that have panels at least partially separated by a contoured cut line. According to one aspect of the invention, one of the panels separated by a contoured cut line is chosen as a trimmed panel of which material is removed.

According to another aspect of the invention, a directional line is incremented along the edge of the trimmed panel formed by the contoured cut line. The directional line is used to define a boundary line that intersects the edge of the trimmed panel at two points. The boundary line and a section of the edge thereby define the perimeter of the area to be removed where the section of the edge is that which lies between the two points where the boundary line and the edge touch or intersect. The area defined by this perimeter is then removed.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE DRAWINGS

FIG. 10 is a perspective view of the carrier of FIG. 9 as it is partially erected.

FIG. 11 is a perspective view of the carrier of FIG. 10 that is fully erected.

DETAILED DESCRIPTION

Figure 1:
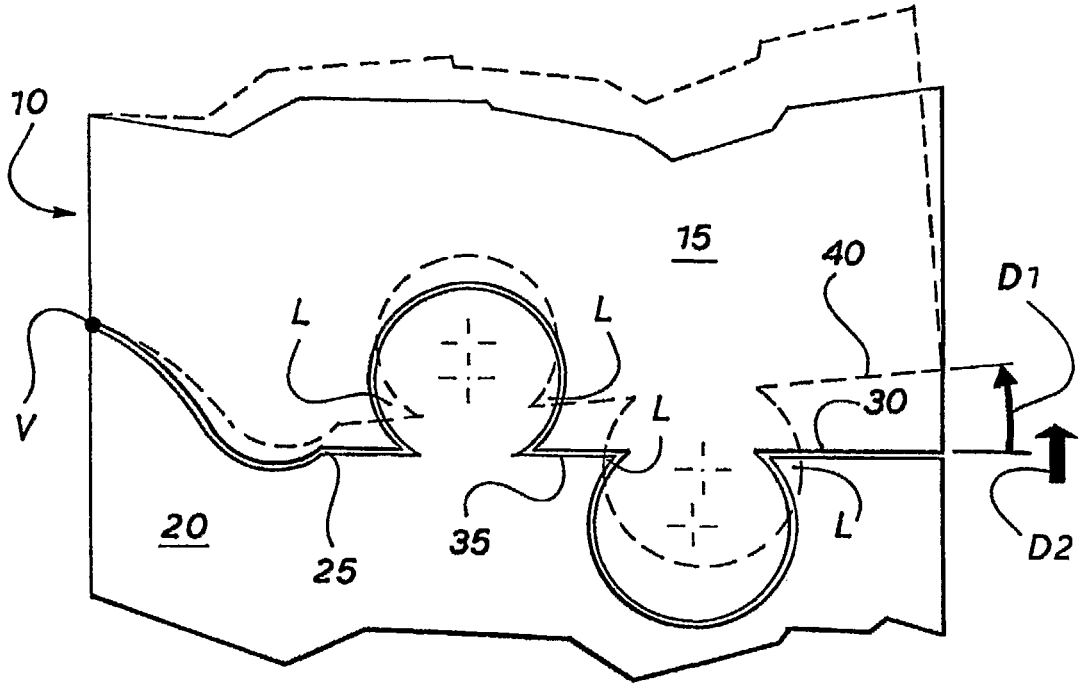
FIG. 1 is a plan view of a section of a blank that illustrates the overlap between two panels when a panel is displaced in a rotational direction.

As required, detailed embodiments of the present invention are disclosed herein. It will be understood that the disclosed embodiments are merely examples to illustrate aspects of the invention that may be embodied in various and alternative forms. The figures are not necessarily to scale, and some features may be exaggerated or minimized to show details of particular components. In other instances, well-known materials or methods have not been described in detail to avoid obscuring the present invention. Therefore, specific structural and functional details disclosed herein are not to be interpreted as limiting, but as a basis for the claims and for teaching one skilled in the art to variously employ the present invention.

Referring now to the drawings, wherein like numerals indicate like elements throughout the several views, the drawings illustrate certain of the various aspects of exemplary embodiments of a method to remove material from an article carrier blank such that the panels of the blank do not interlock as the blank is assembled and erected to form an article carrier.

FIG. 1 is an exemplary embodiment of a section of an article carrier blank 10. The section of the article carrier blank 10 includes a first panel 15 and a second panel 20 separated by a contoured cut line 25. Preferably, but not necessarily, the first panel 15 includes a handle panel and the second panel 20 includes a side panel and one or more end panels. The contoured cut line 25 at least partially defines a first panel edge 30 and a second panel edge 35 beginning at a vertex V and extending to a distal end where the panel edges 30, cease to be formed by the contoured cut line 25. Further, the edges 30, 35 are initially in an aligned or otherwise non-displaced position. In alternative embodiments, the distal end of the contoured cut line 25, opposite vertex V, may be a point where the panels separate, similar to what is shown in FIG. 1, or may connect the two panels to form a second vertex. It should be noted that in the exemplary embodiment the contoured cut line 25 is curved such that each panel edge 30, 35 is both concave and convex to demonstrate the versatility of the method.

Figure 5:
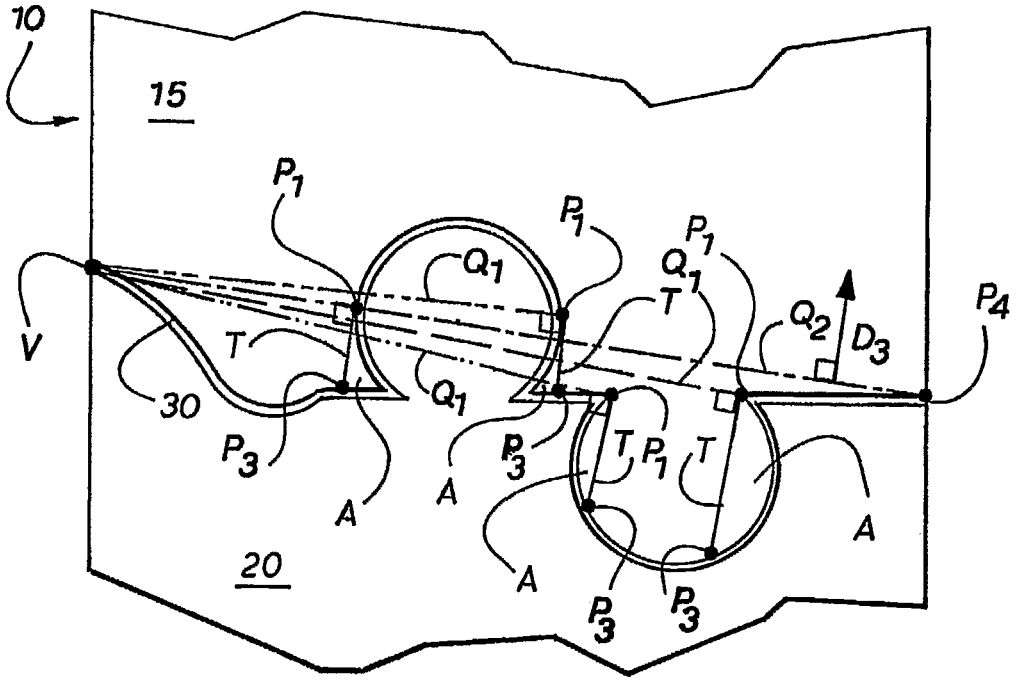
FIG. 5 is a plan view of the section of the blank of FIG. 2 that illustrates alternative boundary lines that define the area where material is to be removed from a panel.

In the exemplary embodiment, the article carrier blank 10 is partially folded or otherwise partially assembled such that the panels 15, 20 tend to displace from the aligned position to a displaced position. In other words, the panels displace from the aligned position such that the panel edges 30, 35 cease to align. For example, the first panel 15 may rotate about the vertex V or otherwise be displaced in a rotational direction D1 as illustrated in FIG. 1 by a first panel edge 40 that represents the displaced first panel edge 30 of the rotated first panel 15. In the exemplary displaced position, the first panel 15 and the second panel 20 have overlapping sections L. It should be noted that the panels 15, 20 are not limited to being displaced in a rotational direction from the aligned position. In alternative embodiments, the panels 15, 20 may be displaced in a linear direction from the aligned position. Further, if the displacement of the first panel 15 from the aligned position in the rotational direction D1 is sufficiently small, the displacement of the first panel 15 can be approximated by displacement in a linear direction, such as direction D3 (as shown in FIG. 5), that is substantially tangent to the rotational direction D1.

Figure 2:
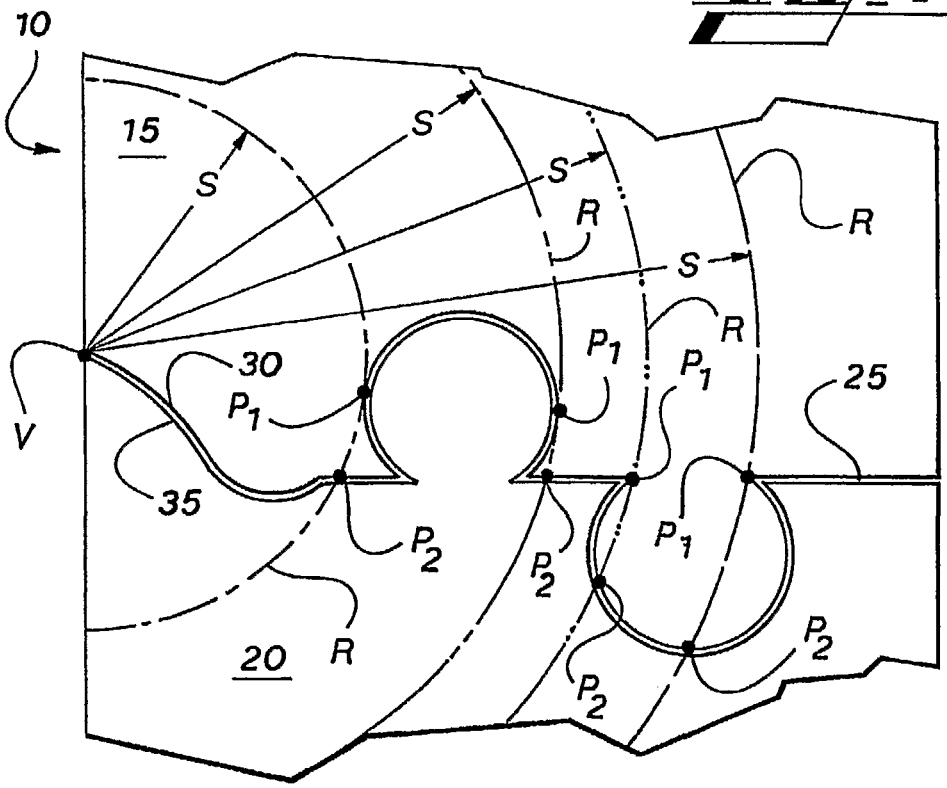
FIG. 2 is a plan view of the section of the blank of FIG. 1 that illustrates the use of directional lines to define two points on the edge of a panel.

As illustrated in FIG. 2, the method defines material to be removed from the article carrier blank 10 so that the panels 15, 20 do not have overlapping sections L (shown in FIG. 1). One of the panels 15, 20 may first be selected as a trimmed panel that is defined as the panel from which material is to be removed. In the illustrated embodiment, the first panel 15 is selected as the trimmed panel although the method could similarly be applied if the second panel 20 is selected as the trimmed panel.

Further, to determine or otherwise define material to be removed from the trimmed panel, a directional line R can be used to at least partially define a boundary line T as described in further detail below. The directional line R preferably, but not necessarily, extends substantially in the direction of displacement. In the exemplary embodiment, the first panel 15 is displaced in the rotational direction D1 and therefore the directional line R (as shown in FIG. 2) is defined as a portion of the circumference of a circle which has a radius S and a center point located at the vertex V. The directional line R can be used to determine points of intersection P1, P2 by incrementally increasing the radius S such that the directional line R is incremented over the first panel edge 30. Two points of intersection P1, P2 are determined to be located on the first panel edge 30 wherever the directional line R intersects or touches two points of the first panel edge 30 and the portion of the directional line R between those two points is disposed on the first panel 15.

Figure 3:
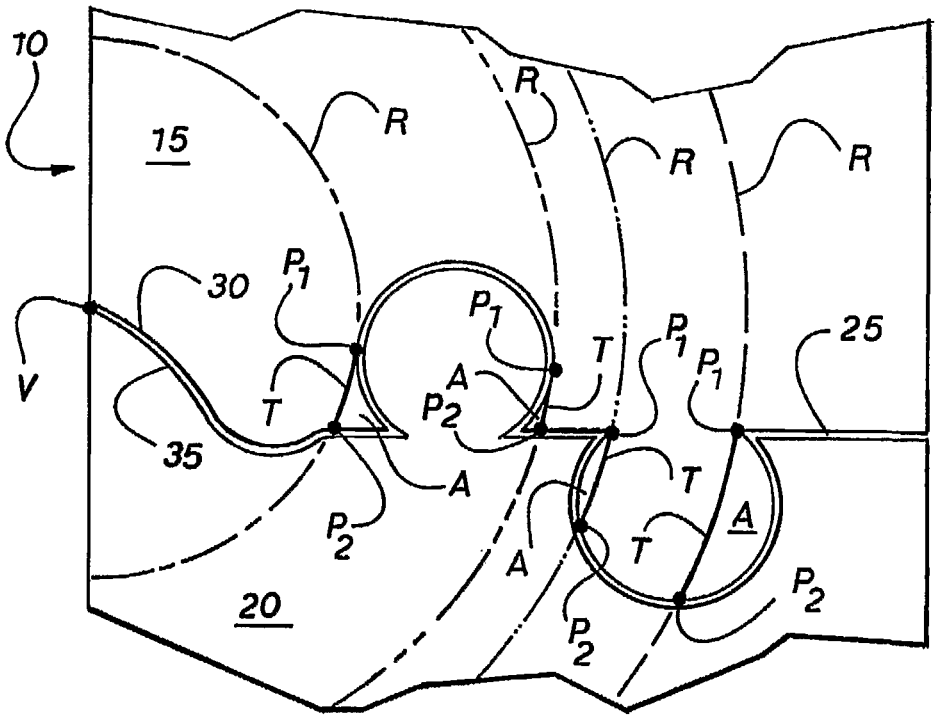
FIG. 3 is a plan view of the section of the blank of FIG. 2 that illustrates boundary lines that define the area where material is to be removed from a panel.

As shown in FIG. 3, the boundary line T at least partially defines the perimeter of an area A to be removed. In the exemplary embodiment, the boundary line T is defined as the portion of the directional line R that is disposed between the points of intersection P1, P2 on the first panel 15. The perimeter of the area A to be removed is defined by the boundary line T and the portion of the first panel edge 30 that lies between the points P1, P2.

Figure 4:
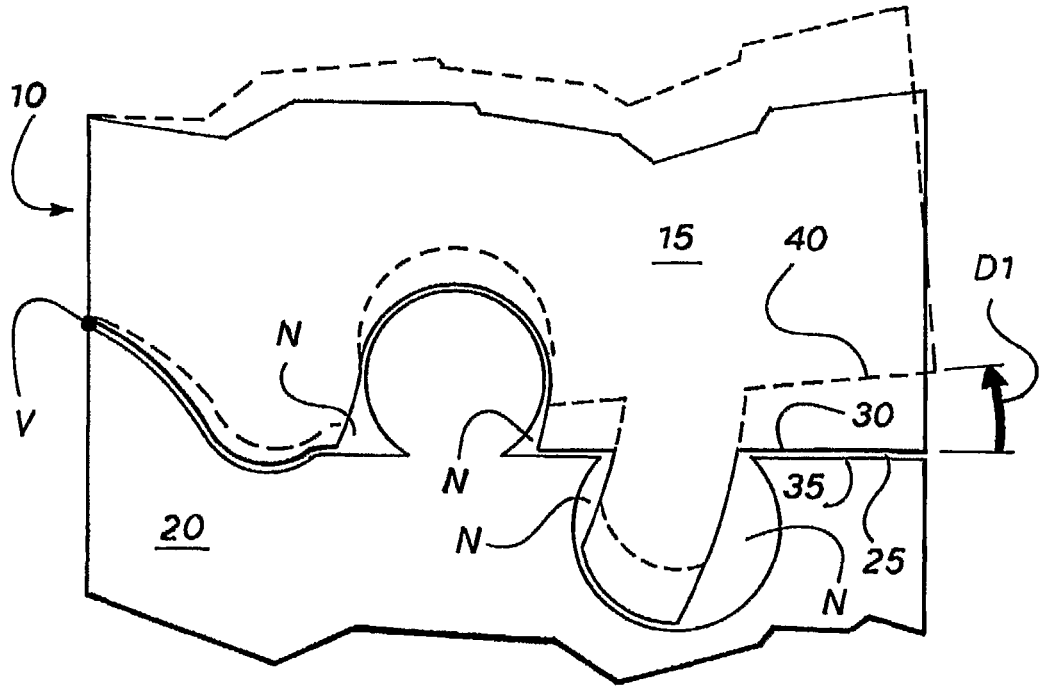
FIG. 4 is a plan view of the section of the blank of FIG. 1 with material removed from the areas shown in FIG. 3 that illustrates the two panels when a panel is displaced in a rotational direction.

FIG. 4 is an illustration of the panels 15, 20 with the areas A (shown in FIG. 3) removed from the first panel 15 to form openings N. Further, similar to the displacement illustrated in FIG. 1, the first panel 15 is displaced in the rotational direction D1 such that the first panel edge 30 is represented by a displaced first panel edge 40. After the areas A have been removed, the first panel 15 and the second panel 20 do not have overlapping sections L (shown in FIG. 1) in the displaced position. Thus, the illustrated method removes material from a selected trimmed panel such that there will be no interlocking or overlapping between the panels 15, 20 of a folded blank 10 that are displaced in the direction D1. Further, one panel will not be trapped under or by another panel as that panel is glued, assembled, or otherwise secured to form the handle section of the article carrier.

In an alternative embodiment, the boundary line T can be defined using the point of intersection P1 as determined above. For example, as shown in FIG. 5, a reference line Q1 can extend between each intersection point P1 and the vertex V. The boundary line T can then be defined as a line between the point P1 and a point P3 on the first panel edge 30 where the boundary line T is preferably, but not necessarily, perpendicular to a respective reference line Q1. It should be noted that each boundary line T can alternatively be defined to be substantially perpendicular to a reference line Q2 that extends between the vertex V and a point P4 that is located at the distal end of the contoured cut line 25. More specifically, each boundary line T can be defined as a line between the point P1 and a point on the first panel edge 30 where each boundary line T extends from the point P1 toward the second panel 20 in a direction that is parallel to an approximate or general direction D3 of displacement. As described above, the boundary line T and the portion of the first panel edge 30 between the points P1, P3 that define the boundary line T define an area A that is removed from the first panel 15 of the blank 10 to form openings N. The alternative embodiments of the method approximate the material to be removed for panels 15, 20 that are displaced in the rotational direction D1.

Figure 6:
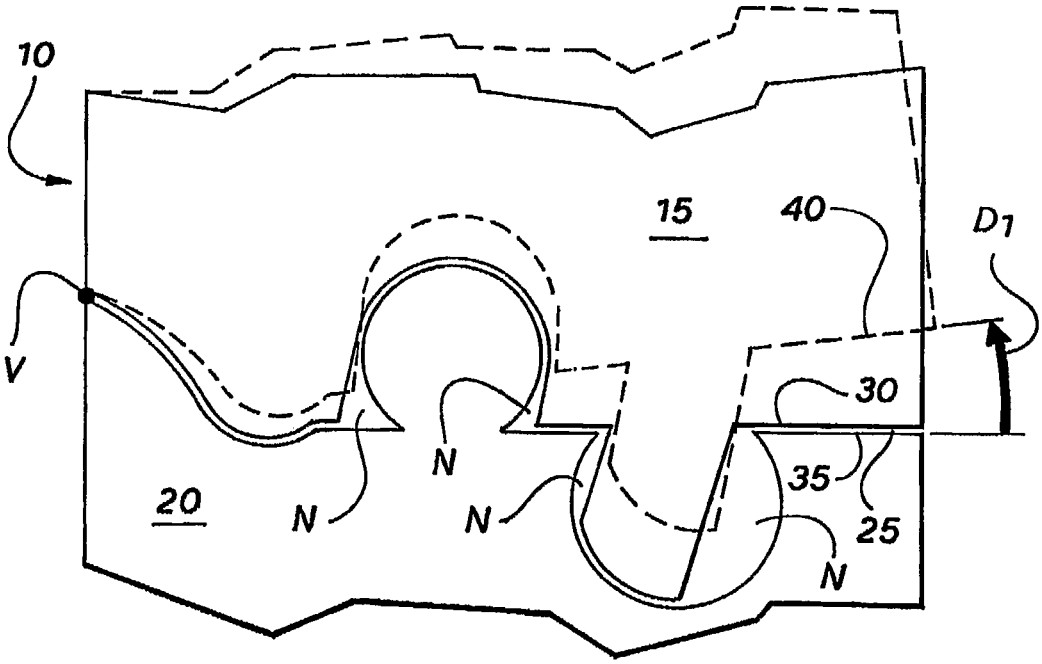
FIG. 6 is a plan view of the section of the blank of FIG. 1 with material removed from the areas shown in FIG. 5 that illustrates the two panels when a panel is displaced in a rotational direction.

FIG. 6 is an illustration of the panels 15, 20 with the area A (shown in FIG. 3) removed from the first panel 15. Similar to the displacement illustrated in FIG. 1, the first panel 15 is displaced in the rotational direction D1 such that the first panel edge 30 is represented by a displaced first panel edge 40. After the areas A have been removed, the first panel 15 and the second panel 20 do not have overlapping sections L (shown in FIG. 1) in the displaced position. Thus, the illustrated method removes material from a selected trimmed panel such that there will be no interlocking or overlapping between the panels 15, 20 of a folded blank 10 that are displaced in the direction D1.

Figure 7:
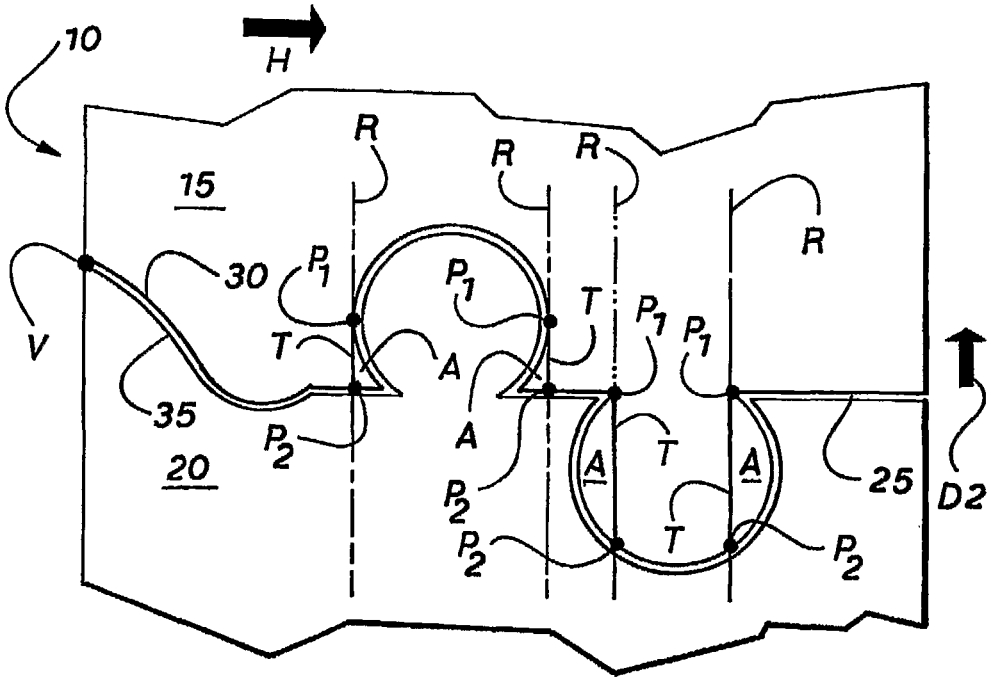
FIG. 7 is a plan view of the section of the blank of FIG. 1 that illustrates the use of alternative directional lines and boundary lines to define two points on the edge of a panel.

In another alternative embodiment, a vertical directional line R can be used to define a boundary line T for a panel 15 that is displaced in a linear direction D2. As shown in FIG. 7, the vertical directional line R is incremented in the horizontal direction H across the first panel edge 30 beginning at the vertex V. Two points of intersection P1, P2 are determined to be located on the first panel edge 30 wherever the directional line R intersects or touches two points of the first panel edge 30 and the portion of the directional line R between those two points is disposed on the first panel 15. The areas A to be removed are defined and removed as described above such that there will be no interlocking or overlapping between panels that are displaced in the direction D2. Those skilled in the art will understand that the linear direction D2 can be direction and the directional line R can be altered to substantially extend in that direction without departing from the scope of the method.

FIGS. 8-11 illustrate the process of erecting an exemplary basket carrier 200 (best shown in FIG. 11) formed from a blank 100 where the exemplary method described above has been used to remove material to form openings N'. The elements in FIGS. 8-11 that are substantially similar in concept to the elements described in FIGS. 1-4 are similarly numbered with the additional designation of a prime symbol to signify that the similarly numbered elements may be physically different.

Figure 9:
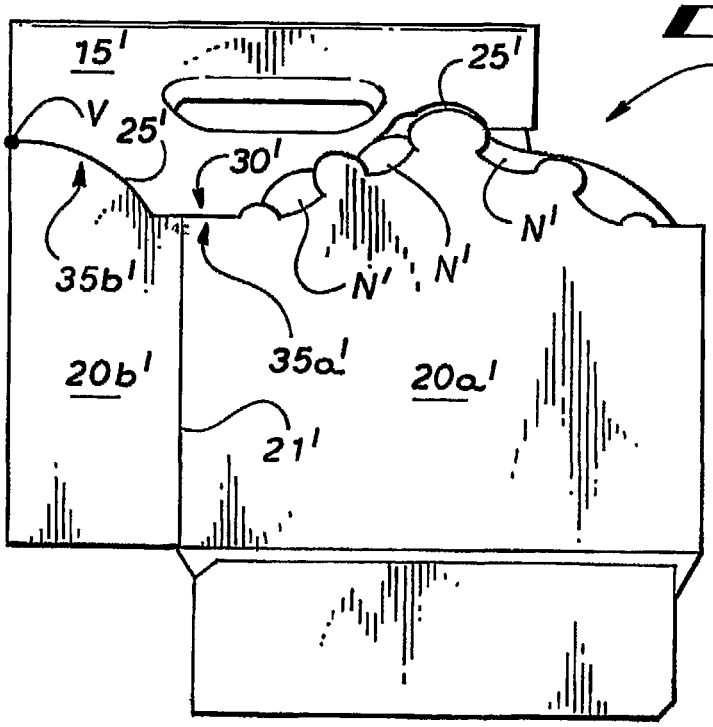
FIG. 9 is a front view of an assembled but collapsed carrier formed from the blank of FIG. 8.
Figure 8:
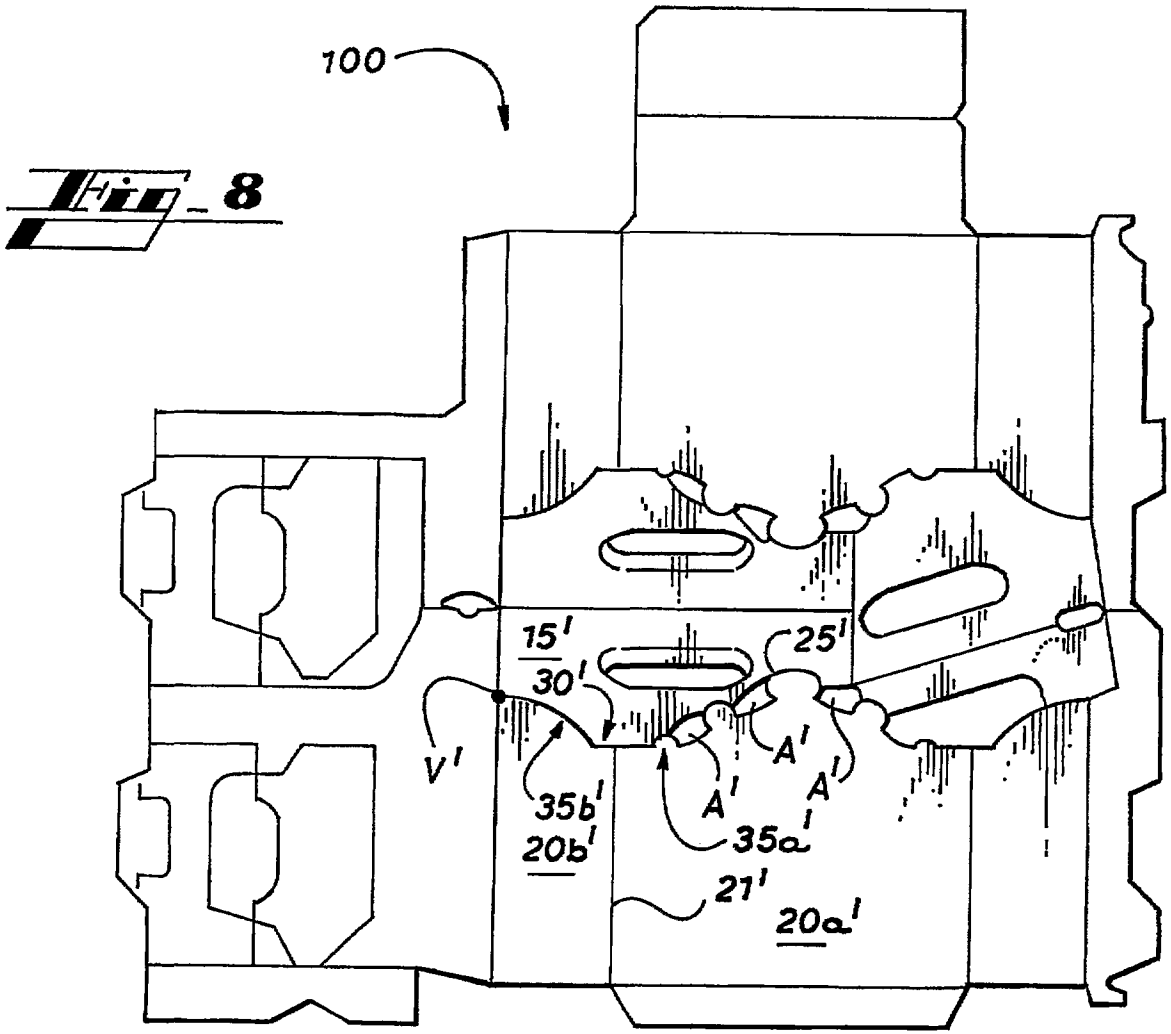
FIG. 8 is a plan view of an exemplary embodiment of a blank where material has been removed according to the present invention.

FIG. 8 is a plan view of the exemplary article carrier blank 100 that may be folded or otherwise assembled to form the collapsed article carrier 200 as shown in FIG. 9. The blank 100 includes a handle panel 15', a side panel 20*a*', and an end panel 20*b*' where the panels 20*a*', 20*b*' are hingedly connected along a fold line 21' and are separated from the handle panel 15' by a contoured cut line 25'. The contoured cut line 25' forms a handle panel edge 30' and side and end panel edges 35*a*', 35*b*' beginning at a vertex V' and extending to a distal end where the panel edges 30', 35*a*', 35*b*' cease to be formed by the contoured cut line 25'.

As shown in FIG. 9, the handle panel edge 30' does not overlap, and is not overlapped by, the side panel edge 35*a*' or the end panel edge 35*b*' as the blank 100 is assembled or otherwise folded and secured to form the collapsed article carrier 200. Thus, as the article carrier 200 is erected, as shown in FIGS. 10 and 11, such that as the side panel 20*a*' and the end panel 20*b*' are pulled from the handle panel 15', the handle panel 15' does not interfere with or otherwise damage the panels 20*a*', 20*b*'. The article carrier 200 is shown as partially erected in FIG. 10 and fully erected in FIG. 11.

It must be emphasized the above-described embodiments are merely exemplary illustrations of implementations set forth for a clear understanding of the principles of the invention. Many variations and modifications may be made to the above-described embodiments without departing from the scope of the claims. All such modifications, combinations, and variation are included herein by the scope of this disclosure and the following claims.

The invention claimed is:

1. A blank for forming a carton, the blank comprising a side panel, an end panel and a handle panel disposed in substantially the same plane, the handle panel being adjacent to at least one of said side and end panels, said handle panel and said at least one panel being separated at least partially by a contoured cut line for defining an upper edge of said at least one panel, wherein said handle panel has a lower edge defined in part by said contoured cut line and in part by an opening between said lower edge of said handle panel and said upper edge of said at least one panel, said opening being defined by a perimeter consisting of a section of said upper edge and a section of said lower edge, wherein the contoured cut line allows said handle panel to be displaced away from said at least one panel in a direction of displacement along said same plane, said opening covering an area defined by a perimeter consisting of a section of said upper edge of said at least one panel and a substantially straight notional boundary line that shares a first point and a second point with said upper edge of said at least one panel, said boundary line extending generally in said direction of displacement.

2. The blank of claim 1, wherein said boundary line extends from said first point toward said at least one panel.

3. The blank of claim 2, wherein said side and end panels are hingedly connected together along a fold line, said boundary line being substantially parallel to said fold line.

4. The blank of claim 3, wherein said fold line defines a corner between said side and end panels when the blank is erected into a carton.

5. The blank of claim 1, wherein said contoured cut line terminates at a vertex, said boundary line being substantially perpendicular to a reference line extending between said vertex and said first point.

6. The blank of claim 1, wherein said contoured cut line terminates at a vertex, said direction of displacement is generally a rotational direction about said vertex.

7. The blank of claim 6, wherein said boundary line is defined generally as a section of the circumference of a circle with a center point located at said vertex.

8. The blank of claim 1, wherein said contoured cut line defines a projection on said at least one panel, said opening being disposed on one side of said projection and adjoining said projection, and said lower edge of said handle panel is further defined by another opening disposed on the other side of said projection.

9. The blank of claim 8, wherein said other opening covers an area defined by a perimeter consisting of a section of said upper edge and by another substantially straight notional boundary line that shares a third point and a fourth point with said upper edge, said other boundary line extending generally in said direction of displacement.

10. A blank for forming a carton, the blank comprising a side panel, an end panel and a handle panel disposed in substantially the same plane, the handle panel being adjacent to at least one of said side and end panels, said handle panel and said at least one panel being separated at least partially by a contoured cut line for defining an upper edge of said at least one panel, wherein said handle panel has a lower edge defined in part by said contoured cut line and in part by an opening between said lower edge of said handle panel and said upper edge of said at least one panel, said opening covering an area defined by a perimeter consisting of a section of said upper edge and a substantially straight notional boundary line that shares a first point and a second point with said upper edge, said boundary line extending generally in a direction of displacement along which said handle panel is allowed by said contoured cut line to be displaced away from said at least one panel along same plane, wherein said contoured cut line defines a projection on said at least one panel, and said opening is disposed on one side of said projection, adjoining said projection.

11. The blank of claim 10, wherein said lower edge of said handle panel is further defined by another opening disposed on the other side of said projection.

12. The blank of claim 11, wherein said other opening is defined by a perimeter consisting of a section of said upper edge and a section of said lower edge.

* * * * *